US011198035B1

(12) United States Patent
Russ

(10) Patent No.: US 11,198,035 B1
(45) Date of Patent: Dec. 14, 2021

(54) ADJUSTABLE HEART POSITION PEDAL EXERCISE MACHINE

(71) Applicant: Joe Russ, Gravette, AR (US)

(72) Inventor: Joe Russ, Gravette, AR (US)

( * ) Notice: Subject to any disclaimer, the term of this patent is extended or adjusted under 35 U.S.C. 154(b) by 0 days.

(21) Appl. No.: 16/985,822

(22) Filed: Aug. 5, 2020

Related U.S. Application Data

(63) Continuation-in-part of application No. 16/045,147, filed on Jul. 25, 2018, now abandoned.

(60) Provisional application No. 62/536,586, filed on Jul. 25, 2017.

(51) Int. Cl.
*A63B 22/06* (2006.01)
*A63B 21/00* (2006.01)

(52) U.S. Cl.
CPC ..... *A63B 22/0605* (2013.01); *A63B 21/4034* (2015.10); *A63B 2022/0652* (2013.01); *A63B 2208/0247* (2013.01); *A63B 2225/093* (2013.01)

(58) Field of Classification Search
CPC .. A63B 22/0605–0694; A63B 21/4034; A63B 2208/0247; A63B 2225/093
See application file for complete search history.

(56) References Cited

U.S. PATENT DOCUMENTS

| | | | | |
|---|---|---|---|---|
| 3,260,324 | A * | 7/1966 | Suarez | B62K 1/00 180/10 |
| 4,147,343 | A * | 4/1979 | Hyde | A63B 19/04 472/16 |
| 6,547,702 | B1 * | 4/2003 | Heidecke | A63B 21/0055 482/62 |
| 9,227,106 | B2 * | 1/2016 | Richards | A63B 21/00192 |
| 2013/0260964 | A1 * | 10/2013 | Chia | A63B 22/0605 482/57 |
| 2018/0015324 | A1 * | 1/2018 | Yeh | A63B 22/001 |

* cited by examiner

*Primary Examiner* — Jennifer Robertson
(74) *Attorney, Agent, or Firm* — Keisling & Pieper PLC; David B. Pieper; Trent C. Keisling

(57) ABSTRACT

An exercise machine with a movable frame seat and pedal to change the level of the user's heart in relation to the pedal.

4 Claims, 4 Drawing Sheets

ADJUSTABLE HEART POSITION PEDAL EXERCISE MACHINE

CROSS-REFERENCE TO RELATED APPLICATIONS

This application claims priority as a CIP of U.S. patent application Ser. No. 16/045,147 filed by Joe Russ on Jul. 25, 2018 entitled Adjustable heart position pedal exercise machine which claims priority from U.S. Patent Application Ser. No. 62/536,586 filed by Joe Russ on Jul. 25, 2017 entitled Adjustable heart position pedal exercise machine; which is are both hereby incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in exercise machines. More particularly, the invention relates to improvements particularly suited for pedal exercise machines to increase cardiovascular fitness. In particular, the present invention relates specifically to a height adjustable pedal machine that provides for positioning the pedals above the heart to increase fitness training performance.

2. Description of the Known Art

As will be appreciated by those skilled in the art, pedal exercise machines are known in various forms. Patents disclosing information relevant to pedal exercise machines include: U.S. Pat. No. 9,669,257 issued to Irving, et al. on Jun. 6, 2017 entitled Bicycling exercise apparatus; U.S. Pat. No. 9,630,049 issued to Hartman, et al. on Apr. 25, 2017 entitled Reciprocating rehabilitation device; U.S. Pat. No. 5,016,870 issued to Bulloch, et al. on May 21, 1991 entitled Exercise device; and U.S. Pat. No. 5,035,418 issued to Harabayashi on Jul. 30, 1991 entitled Cycle type athletic equipment. Each of these patents is hereby expressly incorporated by reference in their entirety.

From these prior references it may be seen that these prior art patents are very limited in their teaching and utilization, and an improved exercise machine is needed to overcome these limitations.

SUMMARY OF THE INVENTION

The present invention is directed to an improved adjustable heart height exercise machine using a base with an adjustable position for the user to change the relationship between the heart level and the foot pedal position or the knee position. In accordance with one exemplary embodiment of the present invention, an exercise machine is presented using a base and a pivoted top frame to adjust the user position. Another embodiment uses a simple base and ram to adjust the upper frame position. Finally, a simple base and vertical pole are used to adjust one end of the exercise machine to vary the heart level of the user in relation to the pedal position and the resultant knee position of the user. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
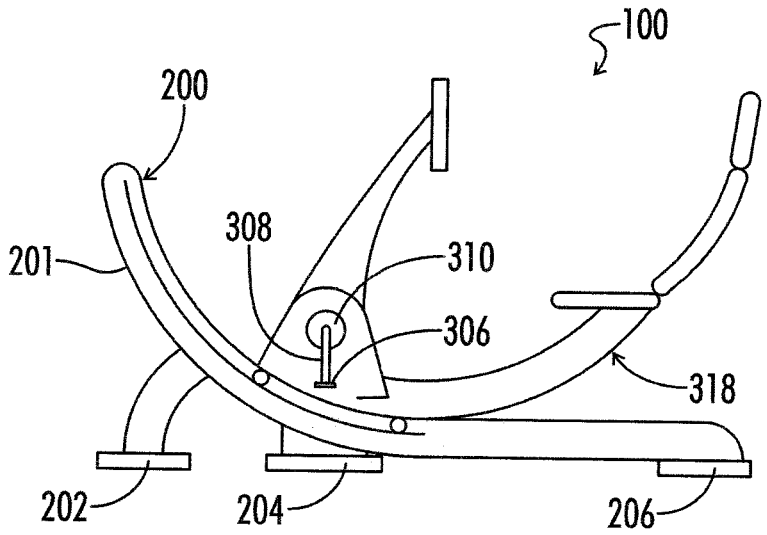
FIG. 1 is a schematic view of an arc adjustment system.
Figure 2:
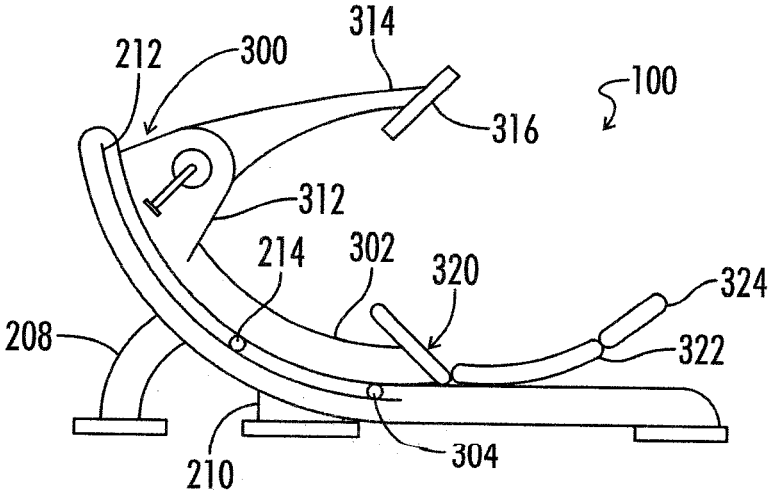
FIG. 2 is a schematic view of an arc adjustment system showing a position adjustment of the seat and pedal to change the user orientation.
Figure 3:
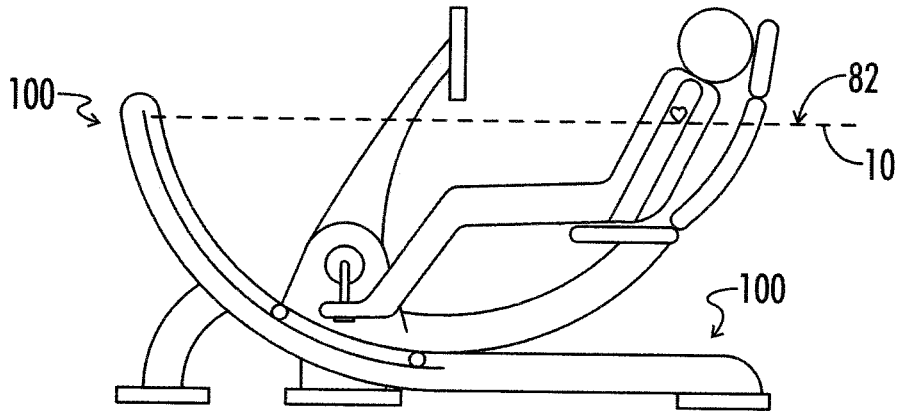
FIG. 3 is a schematic view of an arc adjustment system showing the user in a heart above foot pedal axis position.
Figure 4:
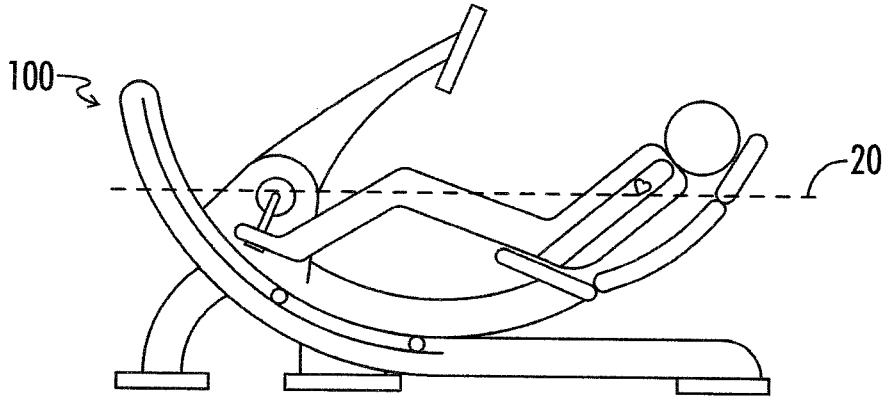
FIG. 4 is a schematic view of an arc adjustment system showing the user in a heart level with knee pedal position.
Figure 5:
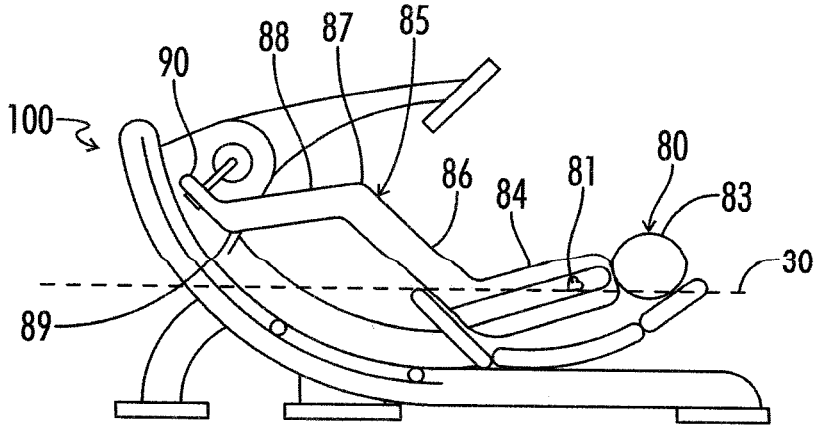
FIG. 5 is a schematic view of an arc adjustment system showing the user in a heart below knee pedal position.
Figure 6:
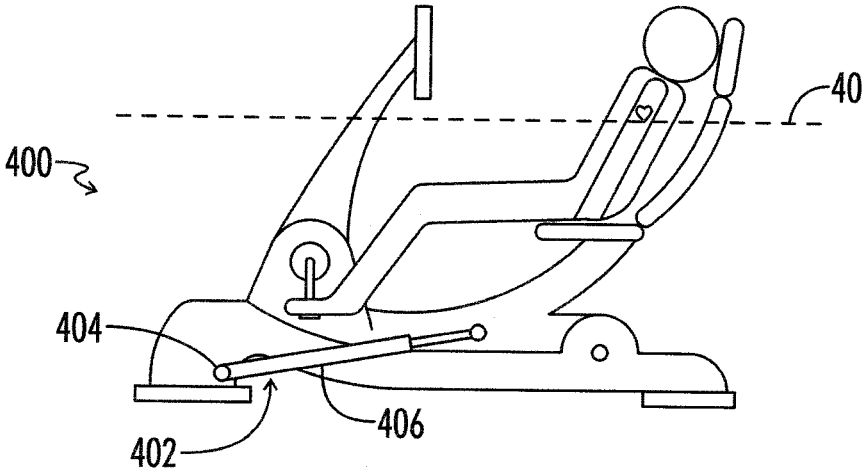
FIG. 6 is a schematic view of a ram lift system showing the user in a heart above foot pedal axis position.
Figure 7:
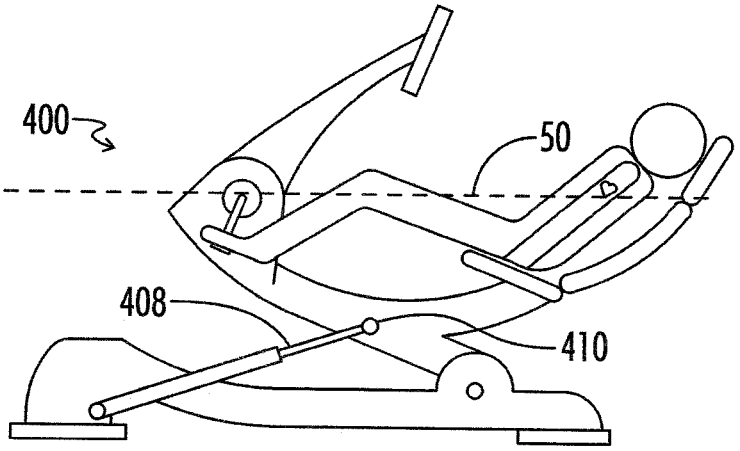
FIG. 7 is a schematic view of a ram lift system showing the user in a heart level with knee pedal position.

As shown in FIG. 1 of the drawings, one exemplary embodiment of the present invention is generally shown as an adjustable heart height exercise machine 100. FIGS. 1-12 show an adjustable heart height exercise machine 100 with FIGS. 3 through 12 showing a heart level 2 at various heights. FIGS. 3, 6, and 9 show a typical exercise position with the heart above knee pedal position 10 which coincides with a heart above foot pedal axis position 40 for these Figures. FIGS. 4, 7, and 10 show a heart level with knee pedal position 20 which coincides with a heart level with foot pedal axis position 50. FIGS. 5, 8, 11, and 12 show a heart below knee pedal position 30 coinciding with a heart below foot pedal axis position 60.

Figure 8:
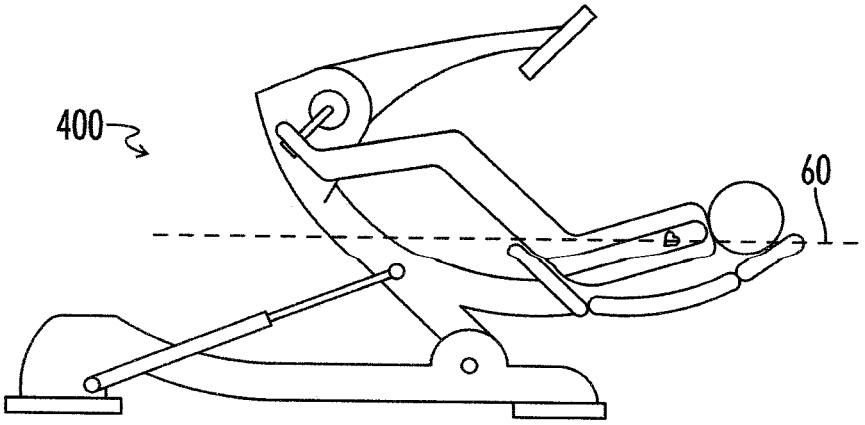
FIG. 8 is a schematic view of a ram lift system showing the user in a heart below knee pedal position.
Figure 9:
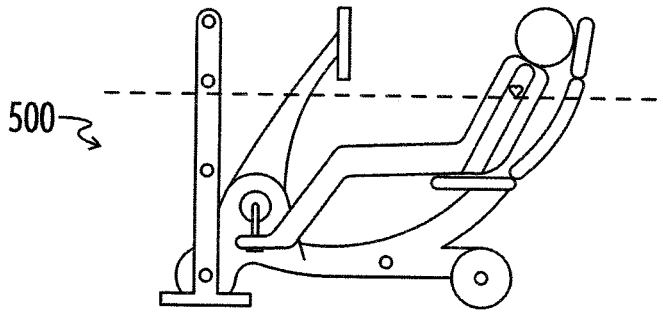
FIG. 9 is a schematic view of a vertical stand lift system showing the user in a heart above foot pedal axis position.
Figure 10:
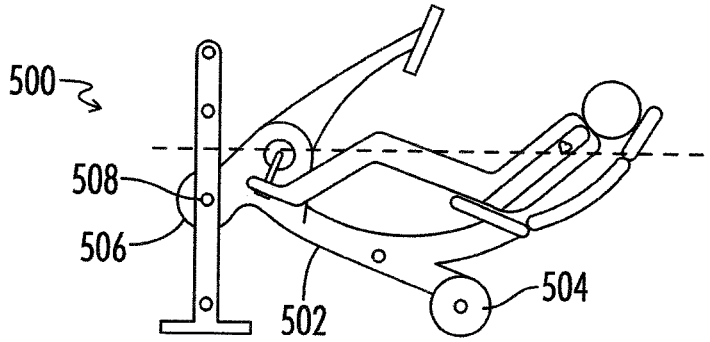
FIG. 10 is a schematic view of a vertical stand lift system showing the user in a heart level with knee pedal position.
Figure 11:
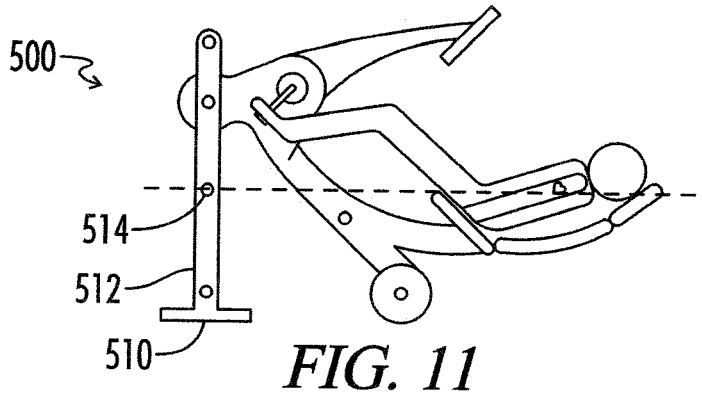
FIG. 11 is a schematic view of a vertical stand lift system showing the user in a heart below knee pedal position.
Figure 12:
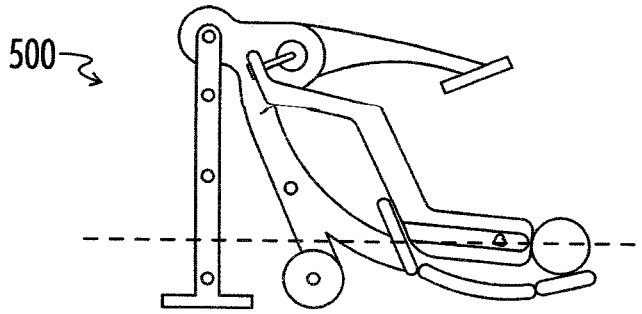
FIG. 12 is a schematic view of a vertical stand lift system showing the user in a heart below knee pedal position.

FIGS. 1 through 12 show various configurations of the adjustable heart height exercise machine 100. FIGS. 1 through 5 show an arc adjustment system 200. FIGS. 6 through 8 show a ram lift system 400. FIGS. 9 through 12 show a vertical stand lift system 500.

The arc adjustment system 200 includes a base frame 201 supported by a front foot 202 connected by a front leg 208, mid foot 204 connected by a mid leg 210, and back foot 206 directly connected to the base frame. The mid foot 204 is generally positioned wider than the front foot 202 and back foot 206 to give a stable platform for the arc adjustment system 200. The base frame 201 includes capture rails 212 that hold roller wheels 214 to moveably support the moving arc frame 300.

The moving arc frame 300 includes a frame body 302 with roller axles 304 to support the roller wheels 214. The moving arc frame 300 also supports a foot pedal 306 attached by a pedal arm 308 to the rotational pedal base 310 mounted inside the pedal frame 312. Note that foot pedal 306 can be a rotating pedal, an elliptical pedal, or even a pedal for a stair-stepper type mechanism Extending upwards from the moving arc frame 300 is the monitor frame 314 that supports a monitor 316 or other screen, paper, or other information or entertainment holder for use during exercise. The back of the moving arc frame 300 supports the seat frame 318 including a seat 320, a back 322, and a headrest 324.

The ram lift system 400 differs in the use of a lift ram 402 that extend from a ram base point 404 to a ram arm point 410 using a ram body 406 and ram arm 408.

The vertical stand lift system 500 differs in using a lift body 502 with a back wheel 504 and front arm 506 defining the user position. A height pin 508 is used with a stand pole 512 mounted on a stand plate 510 to change the angle. The stand pole 512 includes pin holes 514 for the height pin 508.

Reference numerals used throughout the detailed description and the drawings correspond to the following elements:

Heart level 2
Heart above knee pedal position 10
Heart level with knee pedal position 20
Heart below knee pedal position 30
Heart above foot pedal axis position 40
Heart level with foot pedal axis position 50
Heart below foot pedal axis position 60
Adjustable heart height exercise machine 100
Arc system 200
Base frame 201
Front foot 202
Mid foot 204
Back foot 206
Font leg 208
Mid leg 210
Capture rails 212
Roller wheels 214
Moving arc frame 300
Frame body 302
Roller axles 304
Foot pedal 306
Pedal arm 308
Pedal base 310
Pedal frame 312
Monitor frame 314
Monitor 316
Seat frame 318
Seat 320
Back 322
Headrest 324
Ram lift system 400
Lift ram 402
Ram base point 404
Ram body 406
Ram arm 408
Ram aim point 410
Vertical stand lift system 500
Lift body 502
Back wheel 504
Front arm 506
Height pin 508
Stand plate 510
Stand pole 512
Pin holes 514

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. An adjustable heart height exercise apparatus for a user having a torso with a heart defining a heart level, and a foot defining a foot level, the adjustable heart height exercise apparatus comprising:

a base frame;

a moving frame moveably supported by the base frame to move from a first position to a second position;

a movement system including at least two roller wheels to move the moving frame in relation to the base frame, each roller wheel moving along an arc path;

a foot pedal supported by the moving frame, the foot pedal configured for accepting the user's foot;

the foot pedal attached by a pedal arm to a rotational pedal base mounted inside the movement frame wherein the pedal does not affect the movement system;

a seat supported by the moving frame, the seat configured for accepting the user's torso so that the user's heart level is associated with the seat;

wherein the first position has the user's heart level above the foot pedal; and wherein the second position has the user's heart level below the foot pedal.

2. The adjustable heart height exercise apparatus of claim 1, the movement system further comprising:

the arc path defined by arc capture rails connected to the base frame; and the at least two roller wheels movable along the arc capture rails to arcably move the moving frame in relation to the base frame.

3. The apparatus of claim 1, further comprising:

a monitor frame extending upward from the moving frame; and a monitor mounted to the monitor fame.

4. The apparatus of claim 2, further comprising:

a monitor frame extending upward from the moving frame; and a monitor mounted to the monitor fame.

* * * * *